US005235498A

United States Patent [19]

Van Dulmen et al.

[11] Patent Number: 5,235,498

[45] Date of Patent: Aug. 10, 1993

[54] LAMP/REFLECTOR ASSEMBLY AND ELECTRIC LAMP FOR USE THEREIN

[75] Inventors: Hendrikus A. M. Van Dulmen; Henricus M. C. Van Gestel, both of Eindhoven, Netherlands

[73] Assignee: U.S. Philips Corporation, New York, N.Y.

[21] Appl. No.: 827,674

[22] Filed: Jan. 29, 1992

[30] Foreign Application Priority Data

Feb. 21, 1991 [NL] Netherlands ..... 9100304

[51] Int. Cl.[5] ..... F21V 7/00

[52] U.S. Cl. ..... 362/296; 362/287; 362/429; 313/113; 313/580

[58] Field of Search ..... 362/226, 296, 306, 61, 362/287, 429; 313/113, 634, 318, 49, 50, 51, 580

[56] References Cited

U.S. PATENT DOCUMENTS

| | | | |
|---|---|---|---|
| 3,963,916 | 6/1976 | Morton | 362/429 |
| 3,974,370 | 8/1976 | Pearson | 313/49 |
| 4,061,912 | 12/1977 | Levasseur | 362/287 |
| 4,390,935 | 6/1983 | Audesse et al. | 362/296 |

FOREIGN PATENT DOCUMENTS

| | | |
|---|---|---|
| 1472529 | 7/1969 | Fed. Rep. of Germany . |
| 2649185 | 1/1991 | France . |

*Primary Examiner*—Ira S. Lazarus
*Assistant Examiner*—L. Heyman
*Attorney, Agent, or Firm*—Paul R. Miller

[57] ABSTRACT

A lamp/reflector assembly has an electric lamp (10) having a base (13) presenting projections (17-19) which touch an imaginary sphere having its center of curvature coincident with the electrical element (12) of the lamp. The reflector (1) of the assembly has an opening (6) through which the lamp (10) extends, and a convex, spherically curved mounting surface (30) aligned with respect to the opening (6). The mounting surface (30) has its center of curvature substantially coincident with the optical center (4) of the reflector (1). The projections (17-19) of the base bear against the mounting surface (30) and the optical center (4) of the reflector (1) coincides with the electrical element (12), also when the lamp occupies one of a number of positions tilted with respect to the optical axis (3) of the reflector (1).

13 Claims, 5 Drawing Sheets

LAMP/REFLECTOR ASSEMBLY AND ELECTRIC LAMP FOR USE THEREIN

The invention relates to a lamp/reflector assembly comprising

- a reflector having a concave, reflecting surface, an optical axis with an optical center, a luminous window and a lamp opening,
- an electric lamp having a lamp vessel which is sealed in a vacuumtight manner, in which an electric element is positioned and which is connected to a lamp cap provided with contacts, current conductors connecting the electric element to respective contacts of the lamp cap, while the optical, center of the reflector coincides with the electric element,
- a convex, spherically curved mounting surface outside the reflector, aligned relative to the lamp opening in the reflector, which mounting surface has a center of curvature which substantially coincides with the optical center of the reflector, the lamp being connected to the mounting surface and projecting through the lamp opening.

The invention also relates to an electric lamp suitable for use in this assembly.

BACKGROUND OF THE INVENTION

Such an assembly is known from French patent 2 649 185 A1.

The known assembly is designed for use as a headlamp in motor vehicles. The assembly in addition comprises an annular lamp carrier which has a concave, spherical surface and facing away therefrom a flat surface. The lamp carrier is immovably fastened against the mounting surface with its spherical surface.

The electric lamp comprises a lamp cap having a flat circumferential collar. The lamp is held in the annular lamp carrier with its flat collar against the flat surface.

The known assembly has for its object to render it possible for the electric element to be arranged coaxially with the reflector inside the latter while its center coincides with the optical center of the reflector. For realizing such an arrangement, the electric element must be aligned when a lamp is inserted and whenever a lamp is replaced by a new one. If the electric element in the lamp has a tilted position, the lamp carrier can be loosed from the mounting surface, after which the lamp carrier can be shifted over the mounting surface so as to be tilted relative to the optical axis. The electric element can thereby be brought into a position parallel to the optical axis. Subsequently, the collar of the lamp cap can be shifted in two directions over the flat surface in order to let the electric element cover the optical center.

It is often not possible for the user to carry out these alignment steps since they require a high degree of expertise and/or special equipment.

For practical applications, the known assembly has the drawback that a non-expert user is capable of making a greater positioning error by the lateral displacement possibility of the lamp alone, with the flat collar moving over the flat surface of the lamp carrier, than if the lamp carrier were to be just large enough to accommodate the lamp cap. For practical purposes the construction of the known assembly is equivalent to that of a reflector having a fixed lamp opening in which a lamp is laterally displaceable. The construction of the known assembly is accordingly of a totally insufficient accuracy for use in an optical system.

A lamp opening which is just large enough to accommodate the lamp cap does not offer a sufficiently accurate positioning of the electric element in the reflector either. This is caused by the spread in the dimensions of the lamp opening and of the lamp cap which occurs in mass manufacture.

German DE-1 472 529-A discloses an assembly in which the reflector has a lamp opening bounded by a conical wall and the lamp cap has a conical surface, so that the position of the electric element inside the reflector can be three-dimensionally determined.

This latter construction, however, is not sufficiently accurate for various applications because the lamp opening and the lamp cap cannot be manufactured to sufficiently narrow tolerances. Moreover, the accuracy of the position of the electric element along the optical axis is greatest in this case when the cones have the greatest possible apex angle, but the position transverse to the axis is most accurately determined when the cones have a small apex angle, so it is only possible to choose an apex angle which is a compromise. Aspects which then come into play are how securely the lamp cap is pressed into the lamp opening and to what extent a skew position of the lamp cap is prevented.

U.S. Pat. No. 4,061,912 discloses an assembly which is similar to the assembly described in the opening paragraph. In this case, however, the center of curvature of the mounting surface does not lie in the optical center of the reflector but in its lamp opening, and the optical center does not coincide with the electric element. This known assembly is designed for use in a luminaire for theater illumination. It envisions to provide the possibility of changing the position of the electric element, an incandescent body, in the reflector during lamp operation so as to change the shape of the generated light beam. To this end, a lampholder in which the lamp cap of the lamp is accommodated is fastened to the mounting surface with lateral shifting possibility. This renders the same displacement of the incandescent body within the reflector possible as would be possible if the lamp were suspended in a ball joint in the lamp opening. Moreover, the lampholder may be brought to a varying distance from the mounting surface, so that the lamp can project more or less deeply into the reflector. The adjustment possibility of the lampholder is necessary not only for producing light beams of various shapes, but also because the incandescent body assumes a random position relative to the lamp cap, and thus relative to the lampholder. The advantage of this construction with the center of curvature in the lamp opening is that major lateral displacements of the lampholder, and thus of the lamp cap and of the incandescent body, are possible without the lamp opening having to be substantially greater than the diameter of the lamp vessel.

An adjustment possibility for the location of the electric element is only possible in those applications in which an exact position of the electric element is of no importance for obtaining a light beam of a certain kind.

For many applications in optical systems, however, it is necessary for the electric element of a lamp to take up a predetermined position inside the reflector with a high accuracy. It is often not possible then to allow the user to find this location because of the high skill and/or special aids necessary for this. This electric element in these cases must take up a predetermined position relative to a lamp cap, and the lamp cap must automatically assume a predetermined position relative to the reflector, so that the electric element will be in the correct position inside the reflector when the lamp is inserted.

SUMMARY OF THE INVENTION

The invention has for its object to provide a lamp/reflector assembly of the kind described in the opening paragraph which renders possible a high accuracy of the position of the electric element inside the reflector and which nevertheless is of a simple construction. The invention also has for its object to provide an electric lamp suitable for use in this assembly.

According to the invention, this object is achieved in that the lamp cap has a first, a second and a third projection which are tangent to an imaginary sphere whose center of curvature coincides with the electric element, and the projections rest against the mounting surface.

In the lamp of the assembly according to the invention, the position of the electric element is accurately determined relative to the projections at the lamp cap in that the center of curvature of a sphere which these projections touch coincides with the electric element. The lamp cap and the lamp vessel may be placed in an alignment unit during lamp manufacture with the projections of the lamp cap resting against and touching a portion of a sphere. The lamp vessel is then moved until the electric element assumes the predetermined position in the center of curvature of the sphere, after which the lamp vessel and lamp cap are joined together, for example, with lamp cement.

The spherical surface in the alignment unit essentially has the same radius of curvature as the mounting surface which is present in the assembly, aligned relative to the lamp opening.

During mounting of the lamp in the reflector, the projections need only be applied against the mounting surface in order to ensure that the electric element will be in the correct position inside the reflector.

This correct position, therefore, is realised in each of a large number of positions of the lamp cap against the mounting surface. The force with which the lamp cap is pressed against this surface is of no importance in this case.

In a favourable embodiment, the lamp cap has a ceramic body. Especially in this embodiment, it is very favourable for the lamp cap to have projections which touch an imaginary sphere. Inaccuracies in the shape of the lamp cap, which was obtained through baking, are eliminated by this. The lamp is highly insensitive to spread in the shape and dimensions of these projections. In fact, the location of the center of the sphere which these projections touch relative to the lamp cap is determined separately for each individual lamp cap during the assembly of lamp cap and lamp vessel.

The mounting surface may be an external surface of the reflector. Alternatively, however, for example if the distance of the lamp cap to the electric element in the case of a comparatively long lamp is much greater than the distance from the optical center of the reflector to its lamp opening, the mounting surface may be present at a reflector holder in which the reflector is securely fixed.

The surface area of the mounting surface depends on the spread in the possible positions of the lamp cap relative to the reflector which is deemed desirable or admissible in a given application. The mounting surface may be the surface of a spherical zone or portions thereof whose relative positions correspond to the relative positions of the projections of the lamp cap. Such portions of a segment of a spherical surface may be used if the rotation possibility of the lamp cap about an own axis is limited. The surface of a segment of a sphere is present, for example, in a bending-edge where a conical or cylindrical portion of a reflector holder is bent to form a transition to an adjoining conical or flat portion.

The electric element may be, for example, an incandescent body or a pair of electrodes with a discharge path in an ionizable gas between them. The gas may contain metal vapour and/or metal halides. The lamp vessel may have an exhaust tube tip where the lamp vessel, after being provided with its filling, has been sealed off. The lamp vessel is possible surrounded by an outer envelope.

If the lamp vessel has an exhaust tube tip and contains metal vapour and/or metal halides in its gas filling, it is important for the exhaust tube tip to be above the discharge path during lamp operation in order to avoid the exhaust tube tip assuming a comparatively low temperature so that metal vapour and/or metal halides condense there and are thus removed from the discharge.

This may be easily realised in a lamp whose lamp cap has an unround circumference portion which cooperates with a lateral stop connected to the reflector.

In a favourable embodiment, the reflector holder has connected to it a lampholder which has bent tongues as lateral stops for the lamp cap. The lampholder may also comprise means for holding the lamp fixed, for example, a spring having a free end, which spring grips across the lamp cap and is enclosed with its free end in a recess in the lampholder.

In a favourable embodiment, the reflector holder has a first portion and a second portion fastened thereto which keep enclosed between them an edge of the reflector.

The lamp/reflector assembly may be used, for example, in LCD projection TV sets and as a motor vehicle headlamp. The optical center need not necessarily lie on the optical axis of the reflector or be a focus of the reflector. The optical center may also be the center from where light beams must leave the light source in a certain application.

BRIEF DESCRIPTION OF THE DRAWING

Embodiments of the lamp/reflector assembly and of the lamp according to the invention are shown in the drawings, in which.

DESCRIPTION OF THE PREFERRED EMBODIMENTS

Figure 1:
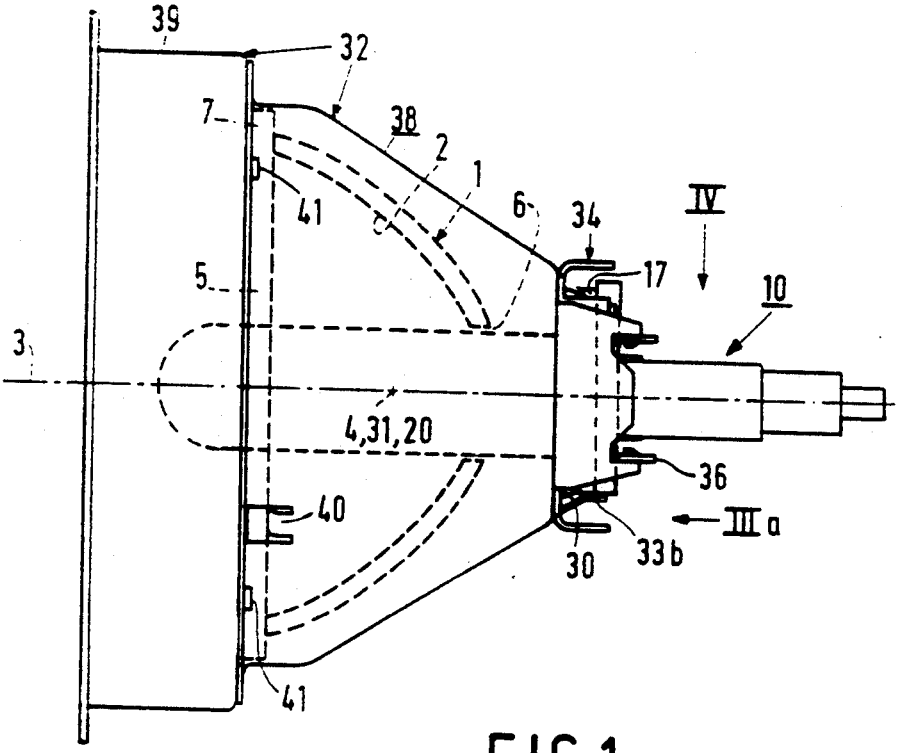
FIG. 1 shows an embodiment of the assembly in side elevation.

In FIG. 1, the lamp/reflector assembly comprises a reflector 1 with a concave reflecting surface 2, an optical axis 3 with an optical center 4, a luminous window 5, and a lamp opening 6. The reflecting surface 2 is paraboloidally curved, but it may alternatively be, for example, spherically or ellipsoidally curved.

An electric lamp 10 (see also FIG. 4) has a lamp vessel 11 which is sealed in a vacuumtight manner, in which an electric element 12 is arranged, and which is connected to a lamp cap 13 provided with contacts 14. Current conductors 15, 16 connect the electric element 12 to respective contacts 14 of the lamp cap 13. The electric element 12 in the Figure is a pair of electrodes with a discharge path in an ionizable gas between them, for example, in mercury, rare gas, and metal halide.

The assembly furthermore has a convex, spherically curved mounting surface 30 outside the reflector 1 aligned relative to the lamp opening 6 in the reflector 1. The lamp 10 is connected to the mounting surface 30, projects through the lamp opening 6, and h as the electric element 12 inside the reflector 1.

The mounting surface 30 has a center of curvature 31 which essentially coincides with the optical center on the axis of the reflector 1.

The lamp cap 13 has a first, a second, and a third projection 17, 18, 19, respectively, which are tangent to an imaginary sphere whose center of curvature 20 coincides with the electric element 12. The first, the second, and the third projection 17, 18, 19, respectively, rest with substantially flat surfaces directly against the mounting surface 30, and the optical center 4 of the reflecting surface 2 coincides with the electric element 12.

In FIG. 1, the mounting surface 30 (see also FIG. 2) is present at a reflector holder 32 in which the reflector 1 is securely fixed. The drawn reflector holder has a first and a second portion 38, 39, respectively, which keep an edge 7 at the reflector 1 enclosed between them. In the embodiment drawn, the first portion 38 for this purpose has stamped-out tongues 40 which are distributed over its circumference, are pressed inwards, and which press against the edge 7, and it is tightened against the second portion 39 with screws 41, thus clamping in the edge 7.

A lampholder 34 for the lamp 10 is fastened to the first portion 38 of the holder 32.

Figure 2:
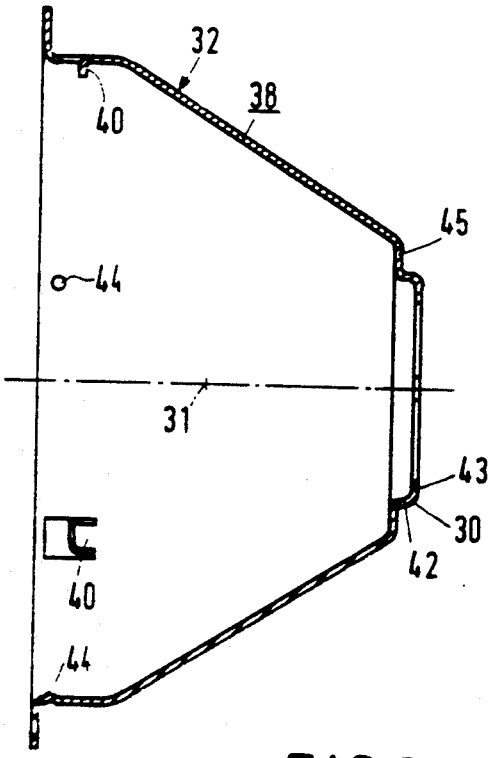
FIG. 2 is a longitudinal section of the reflector holder of FIG. 1.

It is apparent from FIG. 2 that the mounting surface 30 is a bent rim at the first portion 38 of the reflector holder 32. In this embodiment, the mounting surface has the shape of a surface of a segment of a sphere. The first portion 38 of the holder 32 comprises a transition from a cylindrical portion 42 to a flat end portion 43 in the bending rim 30. The first portion 38 has dimples 44 which press laterally against the edge 7 of the reflector 1 in order to center this reflector. The lampholder 34 is mounted in FIG. 1 against a flat portion 45 of reflector holder 32.

Figure 3A:
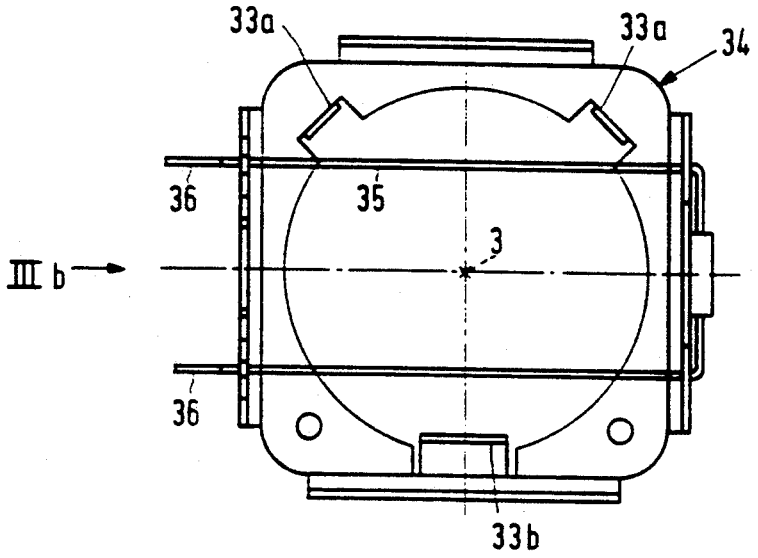
FIG. 3*a* shows the lampholder of FIG. 1 taken on the IIIa.
Figure 3B:
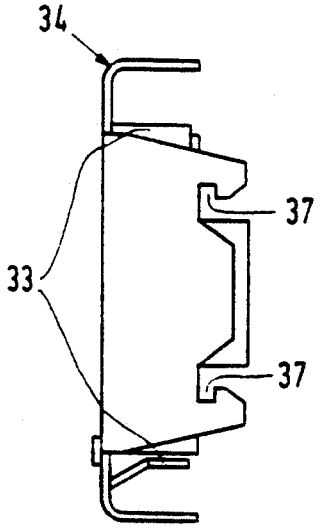
FIG. 3*b* shows the lampholder taken on the line IIIb in FIG. 3*a*.

In FIG. 3, the lampholder 34 has a lateral stop 33 which is connected to the reflector via the reflector holder 32. The stop 33 comprises two bent tongues 33*a* at substantially equal distances from the optical axis 3 and a bent tongue 33*b* at a smaller distance from this optical axis. The stop 33 restricts the rotation possibility of the lamp in the holder in order to keep an exhaust tube tip at the lamp vessel in a desired position relative to the electric element.

The lampholder 34 has fixation means 35, 36, 37 for holding the lamp fixed. In the embodiment drawn, the lampholder 34 has a spring 35 which is U-shaped, grips across the lamp cap 13 (FIG. 1) and has a free end 36 which is enclosed in a recess 37 in the lampholder 34.

The mounting surface 30 projects through the lampholder 34 when the latter is mounted to the reflector holder 32 (FIG. 1).

Figure 4:
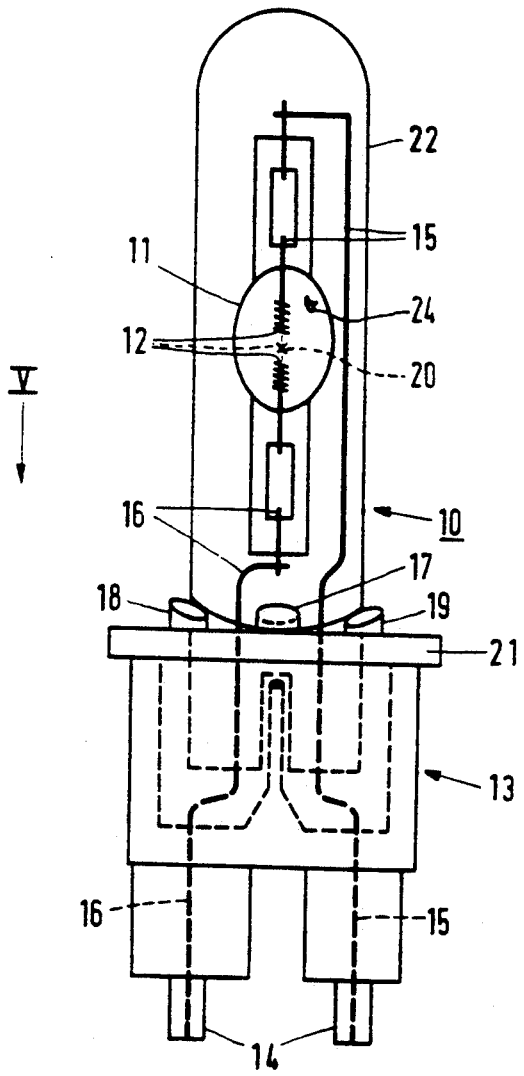
FIG. 4 shows the lamp of FIG. 1 taken on the line IV.
Figure 5:
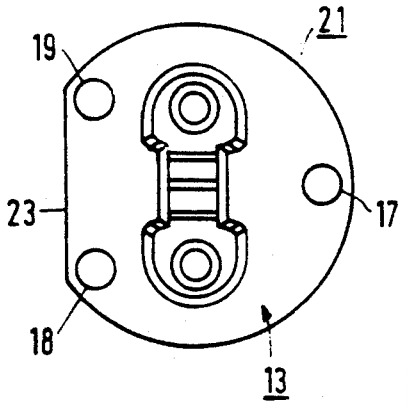
FIG. 5 is an elevation of the lamp cap of FIG. 4 taken on the line V.

FIG. 4, the lamp has a lamp cap 13, for example of ceramic material, with projections 17, 18, 19 which in FIG. 1 touch the mounting surface 30. The lamp vessel 11 is enveloped in a closed outer bulb 22. The lamp cap 13 has an unround circumference portion 21, i.e. an edge with a flat side 23 (FIG. 5). The lamp vessel 11 has an exhaust tube tip 24.

When the assembly has the position shown in FIG. 1, the exhaust tube tip 24 is above the electric element 12 since, as is apparent from FIG. 1, the bent tongue 33*b* which cooperates with the flat side 23 at the lamp cap 13 is below the optical axis 3, diametrically opposite the exhaust tube tip 24.

Figure 6:
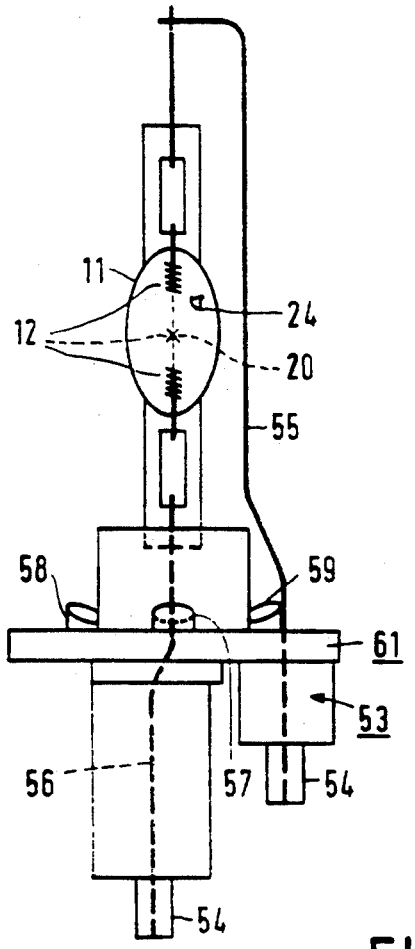
FIG. 6 shows an alternative embodiment of the lamp.
Figure 7:
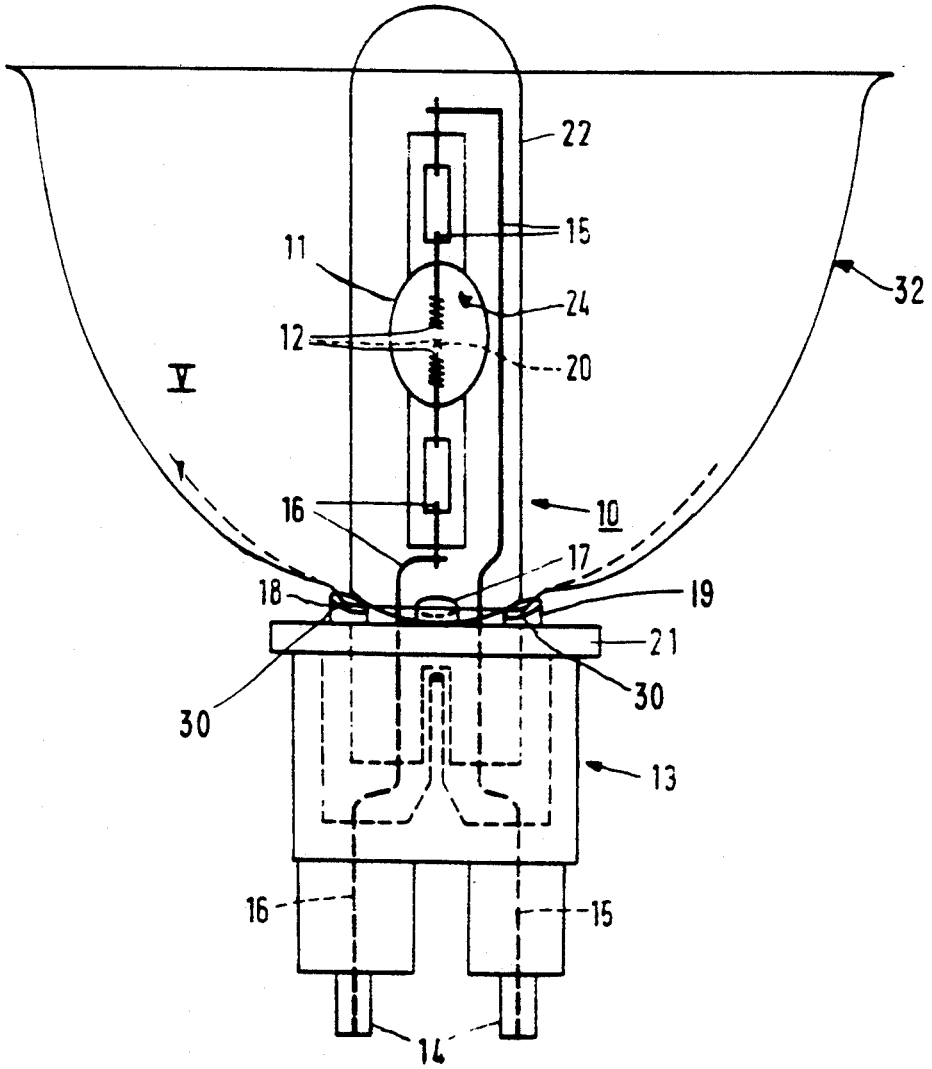
FIG. 7 shows a combinations of figs.

The lamp of FIG. 6 has a similar lamp vessel 11 to those in FIG. 1 and 4, but it has no outer bulb. The reference numerals referring to the lamp cap 53 are 40 higher than those in FIGS. 1 and 4.

In FIGS. 4 and 6, the electric element 12 is positioned relative to the center of curvature 20 of the imaginary sphere touching the ends of the projections 17–19 or 57–59 during assembly of the lamp vessel 11 with the lamp cap 13 or 53. This center of curvature coincides with the electric element 12.

During this assembly, the projections come to rest against the mounting surface 30 (FIG. 1) which is part of the outer surface of a sphere whose center of curvature 31 essentially coincides with the optical center 4 of the reflector 1. Since the electric element is aligned relative to the projections, and the mounting surface relative to the optical center, it is achieved that the electric element will be in a predetermined position, in the optical center, when the projections rest against the mounting surface. Thanks to the imaginary sphere and the outer surface of the sphere forming the mounting surface, the lamp can assume positions which are tilted relative to the optical axis of the reflector, while nevertheless the optical center of the reflector still coincides with the electric element.

As a result, the lamp may be mounted by a non-expert, without aids, in the correct position. The stop necessitates, if applicable, a correct rotational position, if an exhaust tube tip is present. The fixation means keep the lamp in its position, also when the optical axis is not vertically directed, with the luminous window facing downwards.

We claim:

1. In a lamp assembly comprising a reflector structure having a reflecting surface, an electric lamp extending through an opening of said reflecting surface relative to an optical axis of said reflector structure, a mounting structure for holding said reflector structure, and a first means for holding said electric lamp with respect to said mounting structure, the improvement comprising said first means including first, second and third projecting members each having a surface disposed against said mounting structure, said projecting members being disposed about at least one edge of said first means, and said projecting members extending in a direction toward said reflector structure.

2. A lamp assembly according to claim 1, wherein said reflector structure includes a reflector holder for holding a reflector having said reflecting surface disposed thereon, and wherein said mounting structure is disposed at said reflector holder.

3. A lamp assembly according to claim 2, wherein said reflector holder has a first portion and a second portion for enclosing an edge of said reflecting surface.

4. A lamp assembly according to claim 2, wherein said mounting structure has a plurality of mounting surfaces being segments of a sphere, and said surface of said projecting members are disposed against said mounting surfaces.

5. A lamp assembly according to claim 4, wherein said mounting surfaces are at a bending-edge of said reflector holder.

6. A lamp assembly according to claim 2, wherein said first means includes a member connected to said reflector holder.

7. A lamp assembly according to claim 6, wherein said member of said first means has bent tongues to form a lateral stop for said first means.

8. A lamp assembly according to claim 6, wherein said member of said first means includes structural means for maintaining said electric lamp fixed.

9. A lamp assembly according to claim 8, wherein said structural means includes a U-shaped spring gripping said first means, and wherein said U-shaped spring includes at least one free end disposed in a recess of said member of said first means.

10. A lamp assembly according to claim 1, wherein said first means includes a circumferential cross-section having an unround circumferential portion cooperating with a lateral stop disposed to hold said reflector structure.

11. A lamp assembly according to claim 1, wherein said electric lamp includes a lamp vessel closed in a vacuum-tight manner, said lamp vessel enclosing an electric element, said electric element being connected by current connectors to contacts of said first means, and wherein said first means includes a ceramic body fixing said first, second and third projecting members in position.

12. A lamp assembly according to claim 11, wherein said first means includes a circumferential cross-sectional structure having an unround circumferential portion.

13. A lamp assembly according to claim 12, wherein said unround circumferential portion is a flat edge, and wherein said lamp vessel has an exhaust tube tip aligned relative to said flat edge.

* * * * *